US006665511B2

(12) United States Patent
Takeuchi et al.

(10) Patent No.: US 6,665,511 B2
(45) Date of Patent: Dec. 16, 2003

(54) DEVELOPING DEVICE AND IMAGE FORMING APPARATUS INCLUDING THE SAME

(75) Inventors: Nobutaka Takeuchi, Yokohama (JP); Kenzo Tatsumi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/175,785

(22) Filed: Jun. 21, 2002

(65) Prior Publication Data

US 2003/0021614 A1 Jan. 30, 2003

(30) Foreign Application Priority Data

Jun. 22, 2001 (JP) ..... 2001-189751

(51) Int. Cl.[7] ..... G03G 15/09
(52) U.S. Cl. ..... 399/267; 399/277
(58) Field of Search ..... 399/267, 277, 399/265, 272; 430/122

(56) References Cited

U.S. PATENT DOCUMENTS

| | | | | |
|---|---|---|---|---|
| 4,653,427 A | * | 3/1987 | Hosaka et al. | 399/277 X |
| 5,557,382 A | | 9/1996 | Tatsumi et al. | 399/262 |
| 5,734,953 A | | 3/1998 | Tatsumi | 399/262 |
| 5,765,079 A | | 6/1998 | Yoshiki et al. | 399/258 |
| 5,828,935 A | | 10/1998 | Tatsumi et al. | 399/260 |
| 5,887,224 A | | 3/1999 | Mizuishi et al. | 399/62 |
| 5,915,143 A | | 6/1999 | Watanabe et al. | 399/44 |
| 6,006,050 A | | 12/1999 | Watanabe et al. | 399/58 |
| 6,055,388 A | | 4/2000 | Watanabe et al. | 399/58 |
| 6,081,684 A | * | 6/2000 | Naganuma et al. | 399/277 X |
| 6,266,501 B1 | | 7/2001 | Mizuishi et al. | 399/106 |
| 6,449,452 B1 | * | 9/2002 | Kai | 399/267 |
| 6,456,806 B2 | * | 9/2002 | Shoji et al. | 399/277 |
| 2002/0009312 A1 | * | 1/2002 | Sugimoto et al. | 399/277 X |
| 2002/0028092 A1 | * | 3/2002 | Arizumi et al. | 399/267 |
| 2002/0141789 A1 | * | 10/2002 | Terai | 399/267 |

FOREIGN PATENT DOCUMENTS

| | | |
|---|---|---|
| JP | 07-140730 | 6/1995 |
| JP | 2001-027849 | 1/2001 |
| JP | 2001-324873 | * 11/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

In a developing device for an image forming apparatus of the present invention, a main magnetic pole for development has an angle of 60° or below between opposite pole transition points respectively positioned upstream and downstream thereof in a direction of developer conveyance. A flux density between the main magnetic pole and the magnetic pole downstream of the main magnetic pole in the normal direction has a peak value that is 80% of the maximum flux density of the main pole in the normal direction or above. With this configuration, it is possible to reduce various defective images at the same time.

12 Claims, 11 Drawing Sheets

FIG. 5

MAIN POLE ANGLE

| P1–P2 TANGENTIAL FLUX DENSITY | 9 | 6 | 3 | 0 | −3 | −6 | −9 |
|---|---|---|---|---|---|---|---|
| 130 | 5 | 5 | 4.5 | 5 | 5 | 5 | 5 |
| 110 | 4.5 | 4.5 | 4.5 | 5 | 5 | 5 | 5 |
| 90 | 4.5 | 4.5 | 3.5 | 5 | 5 | 5 | 5 |
| 70 | 4 | 3.5 | 3 | 4 | 5 | 5 | 5 |

| | CONDITION 1 | CONDITION 2 | CONDITION 3 |
|---|---|---|---|
| DRUM DIAMETER | $\phi$ 100 mm | $\phi$ 80 mm | $\phi$ 60 mm |
| SLEEVE DIAMETER | $\phi$ 20 mm | $\phi$ 20 mm | $\phi$ 20 mm |

| | TRAILING EDGE | PORTION AROUND CHARACTER |
|---|---|---|
| CONDITION 1 | 5 | 4 |
| CONDITION 2 | 5 | 3.5 |
| CONDITION 3 | 5 | 2 |

| DIFFERENCE V | PORTION AROUND CHARACTER |
|---|---|
| 300 | 3 |
| 250 | 3.5 |
| 200 | 4 |
| 150 | 4.5 |

DEVELOPING DEVICE AND IMAGE FORMING APPARATUS INCLUDING THE SAME

BACKGROUND OF THE INVENTION

1. Field of the Invention

The present invention relates to a developing device for developing a latent image formed on an image carrier with a magnet brush formed on a developer carrier and a copier, printer, facsimile apparatus or similar image forming apparatus including the same.

2. Description of the Background Art

Higher image quality and higher durability both are required of a modern image forming apparatus. More specifically, image quality should be little susceptible to varying environmental conditions and stable despite aging. It is a common practice with a developing device included in an image forming apparatus to use either one of a single-ingredient type developer, i.e., toner only and a two-ingredient type developer that is a mixture of nonmagnetic toner and magnetic carrier. Today, the two-ingredient type developer is predominant over the one-ingredient type developer because of various merits particular thereto. However, a developing device using the two-ingredient type developer has the following problems left unsolved.

A first problem is the omission of the trailing edge of an image. Generally, this problem occurs more frequency as the ratio of the linear velocity Vs of a developing sleeve to the linear velocity VP of a photoconductive element (Vs/Vp) increases. More specifically, this kind of omission refers to an occurrence that the trailing edge of a halftone portion positioned at the downstream side in the direction of sheet feed is short of density or is not developed at all. A second problem is that thin lines cannot be faithfully reproduced, i.e., the ratio of the width of vertical lines to that of horizontal lines increases to 1.4 or above.

Japanese Patent Laid-Open Publication No. 7-140730, for example, discloses an image forming apparatus configured to solve the problems described above. The image forming apparatus disclosed includes a magnet brush type developing unit including a developer carrier and a magnet roller fixed in place in the developer carrier and having a plurality of magnets. The main pole of the magnet roller for development is positioned at an angle of 5° to 20° upstream of a plane containing the center of the magnet roller and that of the image carrier in the direction of developer conveyance. A doctor member also included in the developing unit and the developer carrier are spaced from each other by a distance Hcut ranging from 0.25 mm to 0.75 mm. A nip for development extends over a distance Dsd of 0.3 mm to 0.8 mm. The distances Hcut and Dsd are selected to satisfy a relation of $1.20<Dsd/Hcut<1.60$. Further, the linear velocity Vs of the developer carrier and the linear velocity Vp of the image carrier are selected to satisfy a relation of $1.0 \leqq Vs/Vp \leqq 3.0$. The above document describes that such a configuration obviates sweep marks, i.e., disturbances to a toner layer in a halftone portion and a solid portion to thereby produce images with high, uniform density and clear-cut contours at high speed.

Further, the above Laid-Open Publication No. 7-140730 teaches a plurality of developing units each including a respective sleeve having a plurality of magnetic poles. The developing positions on the sleeves are different from each other color by color; a latent image is developed between magnetic poles by a non-contact system. Two poles sandwiching a developing zone have an intensity of 500 gausses or above each and are spaced from each other by an angle θ above the range of 40° to 70°. Further, a magnet angle θ1 is selected to be between 0° and one-tenth of the above angle θ or less. The document describes that such a configuration stably produces high-quality images with a minimum of fog ascribable to the carrier deposited on the image carrier or a minimum of local omission around a portion where the carrier is deposited.

The omission of portions around a character is a problem recently reported in relation to the developing device using the two-ingredient type developer in addition to the omission of trailing edges. The omission of portions around a character also refers to an occurrence that dots forming a halftone portion are short of density or are not developed at all. However, this kind of omission differs in position from the omission of a trailing edge. More specifically, the omission of a trailing edge occurs when a halftone patch adjoins a non-image portion, the trailing edge of halftone is lost. As for the omission of portions around a character, when a character portion exists in a halftone region (1×1 dot of, e.g., 26% dot), i.e., when the trailing edge of halftone adjoins a solid image region (character region), the halftone portion of the character region is lost.

In the developing device taught in the above Laid-Open Publication No. 7-140730, the distances Hcut and Dsd satisfy a relation of $1.20<Dsd/Hcut<1.60$, as stated earlier. This, however, makes the magnet brush around the point where the sleeve and photoconductive element are closest to each other more rough as the ratio Dsd/Hcut noticeably varies from 1, i.e., as Hcut decreases relative to Dsd. It is true that such a condition enhances the faithful reproduction of horizontal lines and reduces the omission of trailing edges. However, the magnet brush cannot uniformly contact or rub the entire surface of the photoconductive element, resulting in the omission of portions around characters. Moreover, as for a halftone image with density lying in the range of 0.3 to 0.8 (ID), the magnet brush failing to uniformly contact the photoconductive element cannot uniformly reproduce a dot image, causing the halftone image appear granular.

Japanese Laid-Open Publication No. 6-149063 proposes a non-contact type developing device using the two-ingredient type developer. Non-contact type development, however, lacks an intense electric field for development and cannot be easily improved in developing ability. As a result, this type of developing device aggravates the omission of portions around characters although improving the omission of trailing edges and the faithful reproduction of thin lines.

As stated above, it is difficult with the conventional developing devices using the two-ingredient type developer to improve all of the thinning of horizontal lines, the omission of trailing edges and the omission of portions around characters at the same time.

Technologies relating to the present invention are also disclosed in, e.g., Japanese Patent Laid-Open Publication No. 2001-27849.

SUMMARY OF THE INVENTION

It is an object of the present invention to provide a developing device capable of reducing the omission of portions around characters while obviating the thinning of horizontal lines and the omission of trailing edges to thereby reduce defective images, and an image forming apparatus including the same.

A developing device of the present invention includes a developer carrier facing an image carrier, which carries a latent image thereon, via a gap to thereby form a developing zone between the developer carrier and the image carrier. The developer carrier includes a main magnetic pole for development and magnetic poles respectively positioned upstream and downstream of the main magnetic pole in a direction of developer conveyance for conveying a developer. The developer forms a magnet brush on the surface of the developer carrier. The main magnetic pole has an angle of 60° or below between its opposite pole transition points respectively positioned upstream and downstream of the main pole in the direction of developer conveyance. A flux density between said main magnetic pole and the magnetic pole downstream of the main magnetic pole in the normal direction has a peak value that is 80% of the maximum flux density of the main pole in the normal direction or above.

An image forming apparatus including the above developing device is also disclosed.

BRIEF DESCRIPTION OF THE DRAWINGS

The above and other objects, features and advantages of the present invention will become more apparent from the following detailed description taken with the accompanying drawings in which:

FIG. 5 is a table listing experimental results relating to the omission of trailing edges;

DESCRIPTION OF THE PREFERRED EMBODIMENT

Figure 1:
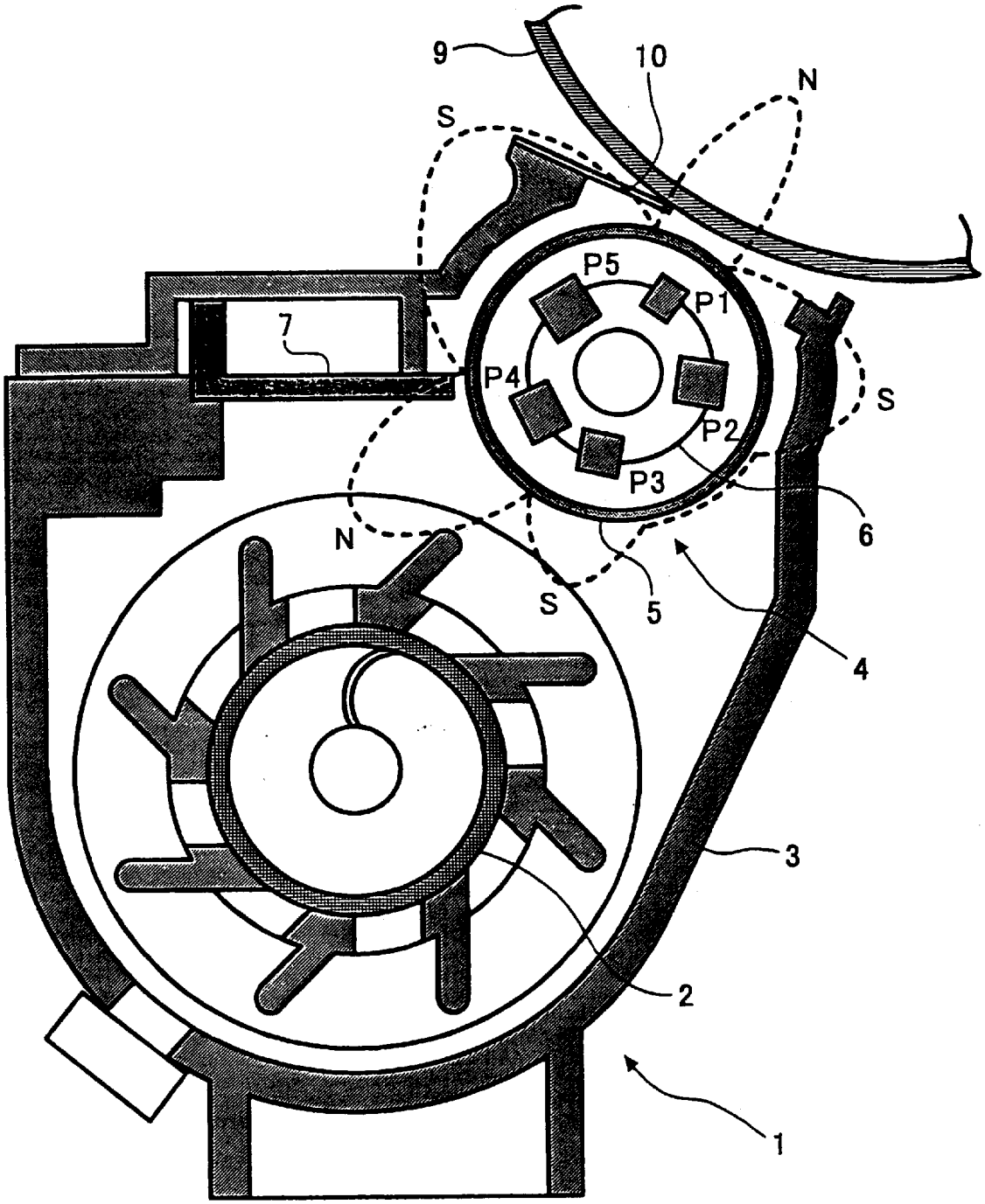
FIG. 1 PRIOR ART
FIG. 1 is a view showing a conventional developing device using a two-ingredient type developer.

To better understand the present invention, brief reference will be made to a conventional developing device of the type using a mixture of nonmagnetic toner and magnetic carrier as a developer, shown in FIG. 1. As shown, the developing device, generally 1, includes a casing 3 accommodating a developing roller or developer carrier 4. The developing roller 4 is made up of a sleeve 5 and a magnet roller 6 disposed in the sleeve 5. The developing roller 4 and a photoconductive drum 9 face each other, forming a developing zone therebetween. A paddle 2 is also accommodated in the casing 3 for conveying the developer toward the developing roller 4 while agitating it.

The sleeve 5 is a hollow cylinder formed of aluminum or similar nonmagnetic material. The magnet roller 6 is fixed in place inside the sleeve 5. A driveline, not shown, causes the sleeve 5 to rotate clockwise as viewed in FIG. 1. The magnet roller 6 includes a main pole or main magnet P1 for causing the developer to rise in developing zone in the form of a magnet brush. A pole P4 scoops up the developer onto the sleeve 5. A pole P5 is positioned upstream of the main pole P1 for conveying the developer deposited on the sleeve 5 to the developing zone. Poles P2 and P3 are positioned downstream of the main pole P1 for conveying the developer in the zone following the developing zone. These poles or magnets P1, P4, P5, P2 and P3 each are oriented in the radial direction of the sleeve 5.

In the developer deposited on the sleeve 5, the carrier rises in the form of brush chains along the magnetic lines of force issuing from the magnet roller 6 in the normal direction. The charged carrier deposits on the brush chains to thereby form a magnet brush. The sleeve 5 in rotation conveys the magnet brush in the clockwise direction as viewed in FIG. 1. A doctor blade 7 is located between the position where the developer deposits on the sleeve 5 and the developing zone in order to regulate the height of the brush chains, i.e., the amount of the developer to reach the developing zone. An anti-scattering member 10 prevents the toner and carrier from being scattered around.

A power supply, not shown, applies either a DC voltage or an AC-biased DC voltage to the sleeve 5 as a bias for development. The bias forms an electric field, which corresponds to a latent image formed on the drum 9, between the drum 9 and the sleeve 5. In this condition, the toner charged by friction acting between it and the carrier flies toward the drum 9 along the electric field to thereby develop the latent image.

Figure 2:
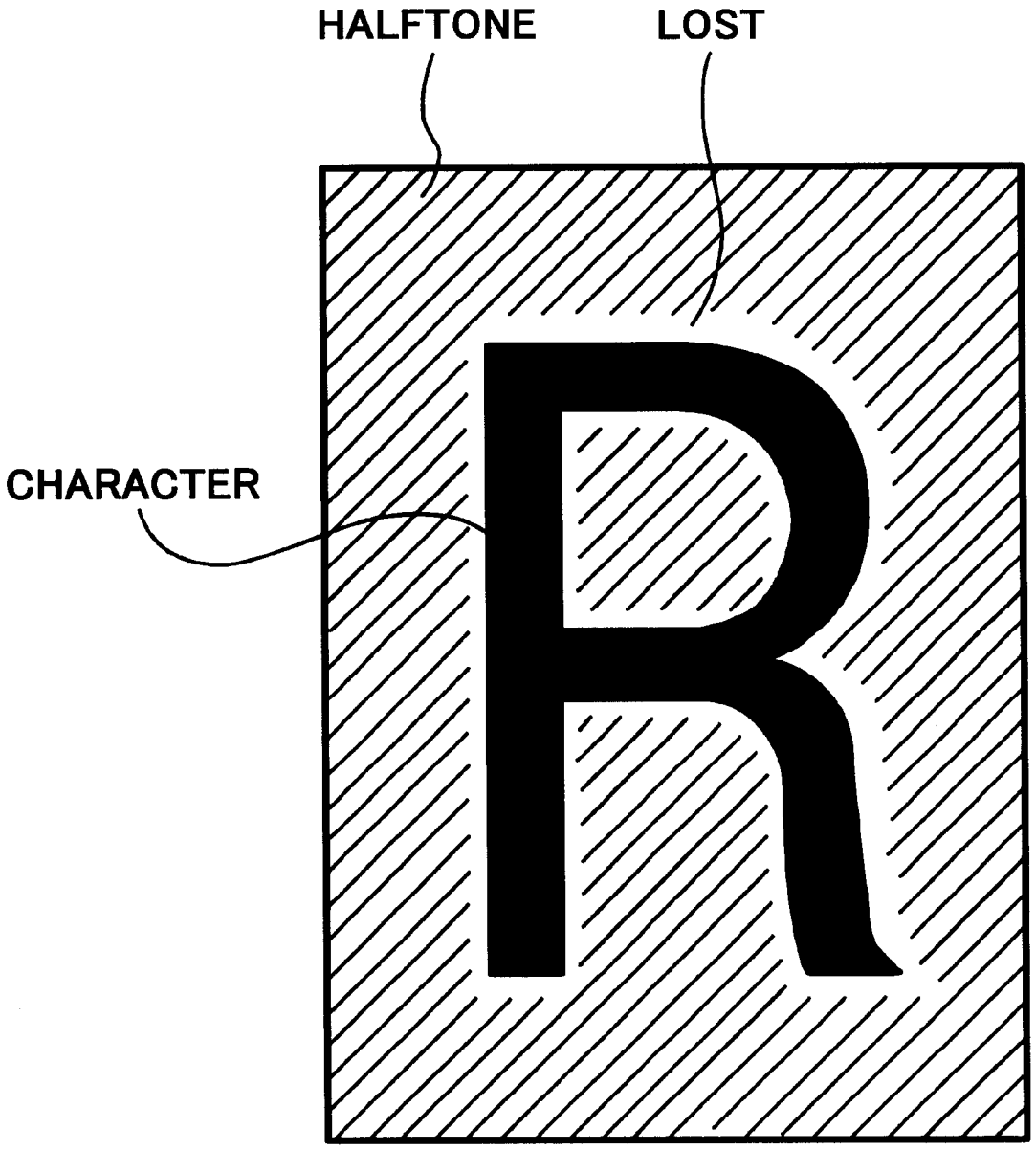
FIG. 2 PRIOR ART
FIG. 2 is a view demonstrating how portions around a character are lost.

The developing device 1 with the above configuration has the problems discussed earlier, i.e., the thinning of horizontal lines, the omission of trailing edges, and the omission of portions around characters. As for the omission of trailing edges, when a halftone patch adjoins a non-image portion, the trailing edge of the halftone is lost, as stated previously. By contrast, when a character portion exists in halftone (1×1 dot of, e.g., 25% dot), i.e., when the trailing edge of halftone adjoins an image region (character region), a halftone portion around a character is lost, as shown in FIG. 2 specifically. It is therefore difficult to obviate all of the problems stated above at the same time.

Figure 3:
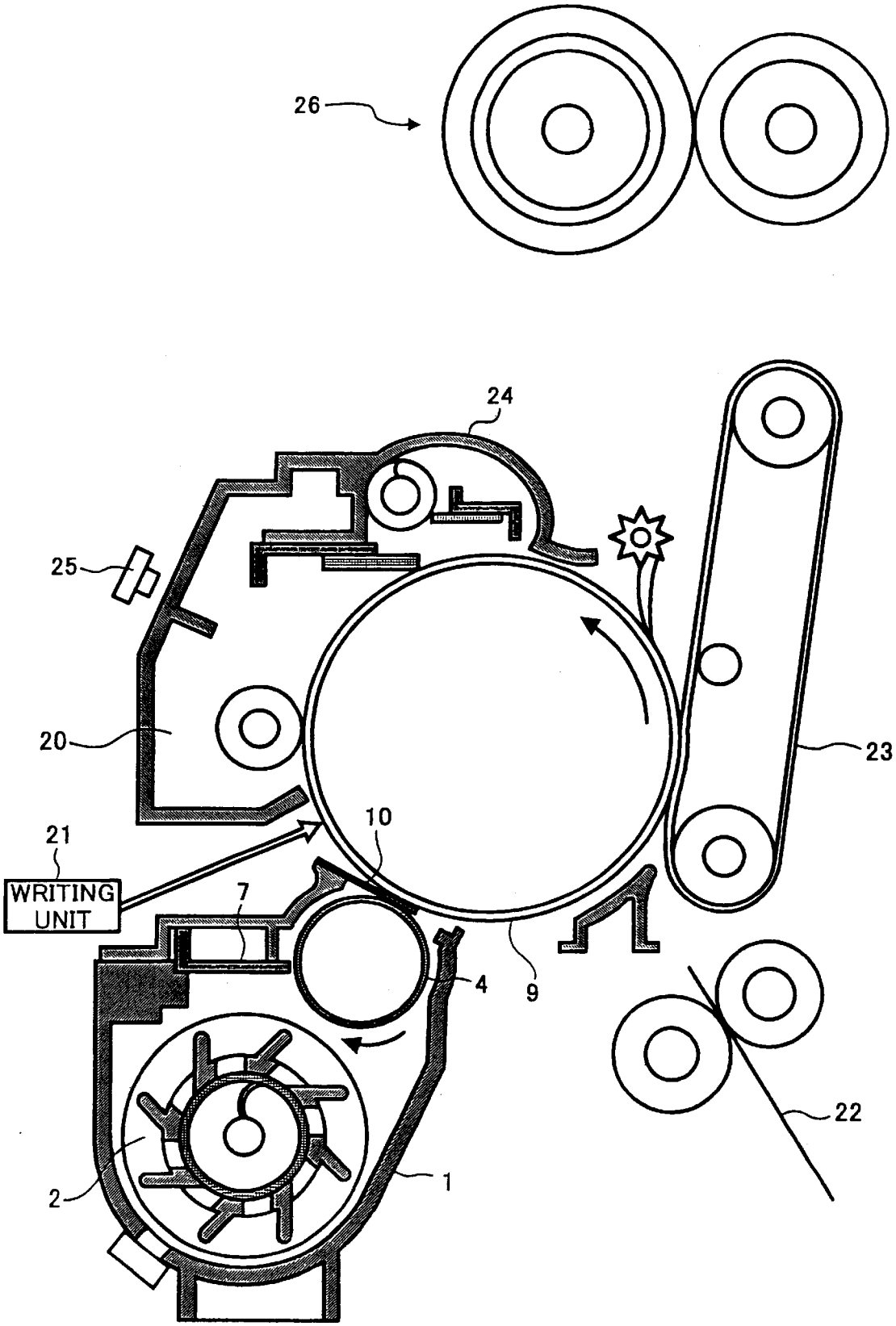
FIG. 3 is a view showing an image forming apparatus embodying the present invention.

Referring to FIG. 3, an image forming apparatus embodying the present invention will be described. As shown, the image forming apparatus includes a photoconductive drum or image carrier 9. Arranged around the drum 9 are a charger 20, an optical writing unit 21, a developing device 1, an image transferring device 23, a drum cleaner 24, and a discharger 25. The charger 20 uniformly charges the surface of the drum 9. The optical writing unit 21 scans the charged surface of the drum 9 with, e.g., a laser beam in accordance with image data to thereby form a latent image. The developing device 1 develops the latent image with toner for thereby producing a corresponding toner image. The image transferring device 23 is implemented by, e.g., a belt, a roller or a charger and transfers the toner image from the drum 9 to a sheet or recording medium 22, which is fed from a sheet feeder not shown. The drum cleaner 24 removes the toner left on the drum 9 after the image transfer. The discharger 25 dissipates charge left on the cleaned surface of the drum 9, thereby preparing the drum 9 for the next image forming cycle.

The sheet 22 carrying the toner image thereon is conveyed from the image transferring device 23 to a fixing unit 26. The fixing unit 26 fixes the toner image on the sheet 22.

Figure 4:
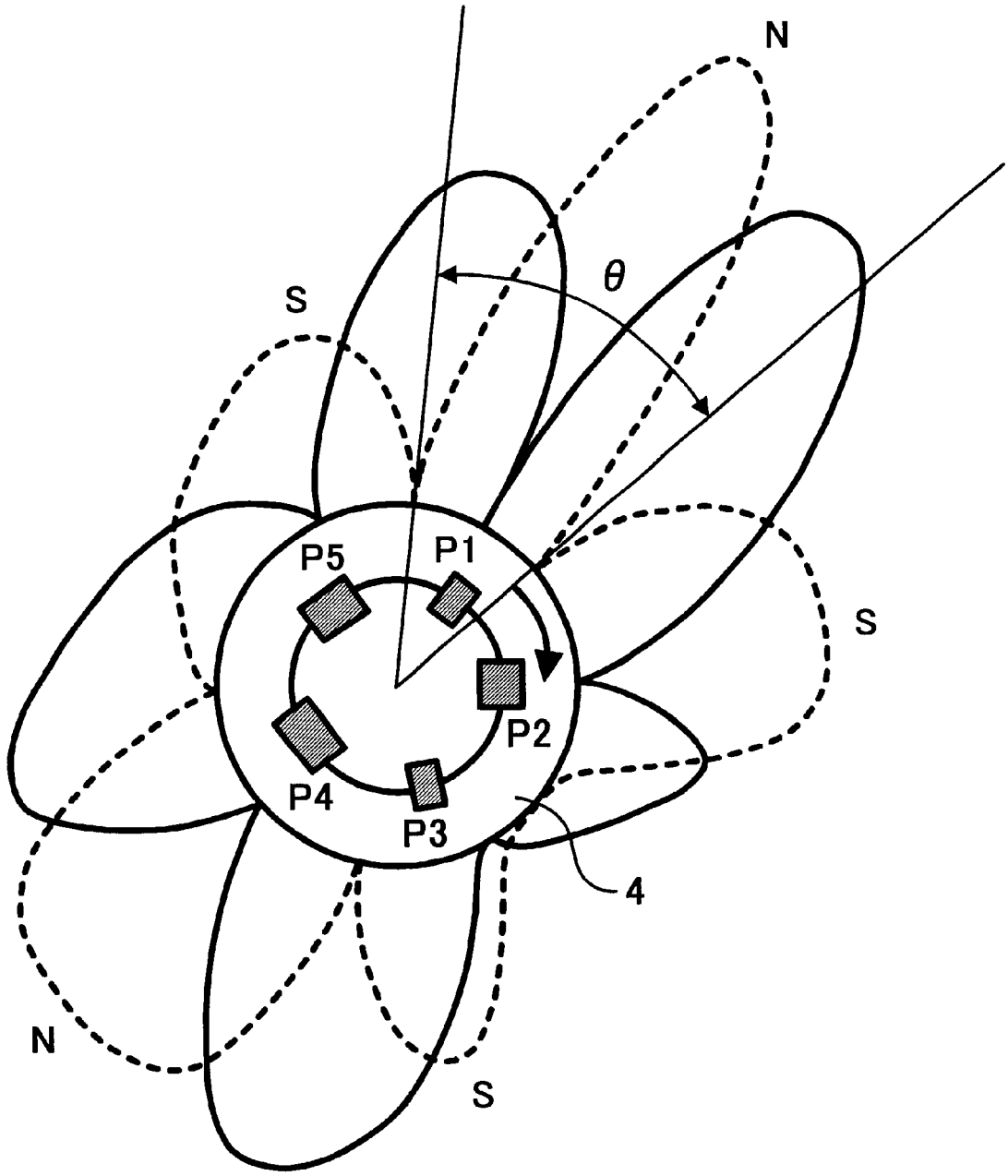
FIG. 4 shows the distribution of magnetic forces of a magnet roller included in a developing device mounted on the apparatus of FIG. 3.

The developing device 1 is essentially similar in construction to the conventional developing device 1 shown in FIG. 1. As shown in FIG. 4, a magnet roller 6 forms flux densities in the normal direction (normal flux densities hereinafter), as indicated by dotted lines, and flux densities in the tangential direction (tangential flux densities hereinafter), as indicated by solid lines. A main pole or main magnet P1 included in the magnet roller 6 has an intense magnetic force and has an angular width θ of as small as 60° or below between opposite pole transition points (zero-gauss points). It is well known that the magnet roller 6 with such a small width θ allows a developing device to bring about a minimum of omission of trailing edges and a minimum of thinning of horizontal lines.

We experimentally determined a relation between the omission of trailing edges and the tangential flux density between the poles P1 and P2 by varying the flux density while maintaining the width θ of the pole P1 constant. While the peak normal flux density of the main pole P1 can generally be varied between the maximum density of 160 mT (millitesla) and the minimum density of 80 mT, we maintained the peak normal flux density constant. The maximum normal flux density of the main pole P1 is determined by the half values and normal flux densities of the poles P2 and P5, which are respectively positioned downstream and upstream of the main pole P1 in the direction of developer conveyance. Generally, a normal flux density and a tangential flux density are inversely proportional to each other. Therefore, to vary the tangential flux density while maintaining the normal flux density of the main pole P1 constant, we varied the energy of a pole that generated the preselected normal flux density of the main pole P.

To vary the amount of energy of the main pole P1, there may be varied, e.g., the number of turns of a coil wound round a yoke or a current to flow through the coil. In the illustrative embodiment, different poles were prepared as the main pole P1, and each was buried in a particular position to thereby adjust the flux density. The peak flux density and half value of the pole P2 were used as parameters that caused the tangential flux density between the poles P1 and P2 to vary. While the angle between the peaks of the poles P1 and P2 may be varied to control the above tangential flux density, it was fixed for experiments.

With the above principle, we prepared four magnet rollers respectively having tangential flux densities of 130 mT, 110 mT, 90 mT and 70 mT between the poles P1 and P2. By varying the angles of the main poles P1 of the four magnetic rollers between 9° and −9° by each 3°, we estimated the omission of trailing edges. FIG. 5 is a table listing the results of estimation. In FIG. 5, rank 5 indicates no omission, as observed by eye, while rank 1 indicates the worst omission, which was 1 mm to 1.2 mm wide. Ranks 4 and 5 are fully acceptable in practical use.

As FIG. 5 indicates, when the peak value of the tangential flux density between the poles P1 and P2 was 80% of the normal flux density of the main pole P1 or above, the target value as to the omission of trailing edges was achieved under all conditions. It is to be noted that the magnet rollers with the tangential flux densities of 130 mT and 110 mT satisfy the above relation.

Figures 6, 7:
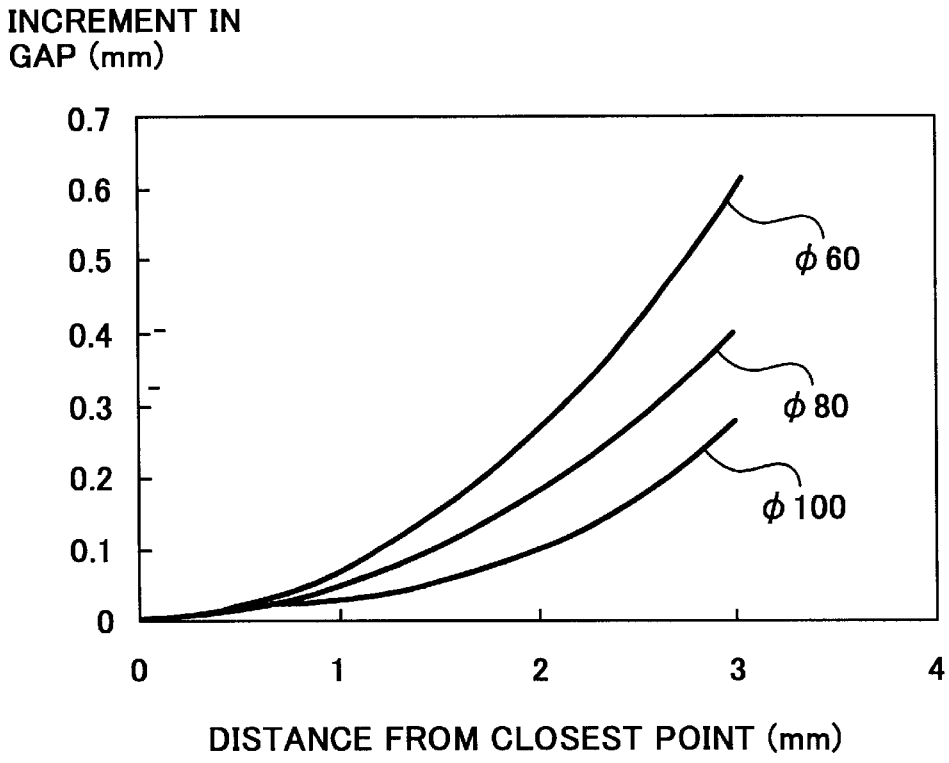
FIG. 6 is a table listing different experimental conditions.
FIG. 7 is a graph showing the sizes of a gap for development in a developing zone.

We conducted a series of experiments with a magnet roller satisfying the above-stated relation to see if the omission of trailing edges and that of portions around characters could be obviated at the same time. As shown in FIG. 6, we prepared three different conditions 1, 2 and 3. While the sleeve had a diameter of 20 mm in all of the conditions 1 through 3, the drum 9 had diameters of 100 mm, 80 mm and 60 mm in the conditions 1, 2 and 3, respectively.

The following developing conditions were applied to all of the conditions 1 through 3:

gap for development: 0.4 mm scoop-up rate ρ of developer: 35–70 mg·cm$^2$ toner grain size: 6.5 μm carrier grain size: 50 μm drum linear velocity: 240 mm/sec sleeve linear velocity ratio: 2.5

Because the sleeve diameter was the same in all of the conditions 1 through 3, a magnet brush formed by the main pole P1 was about 4 mm wide in all of the conditions 1 through 3. In addition, the main pole P1 had an angle of 0° on a line connecting the center of the drum 9 and that of the sleeve 5.

FIG. 7 shows curves representative of the variations of the gap for development in the nip at both sides of the point where the sleeve 5 and drum 9 are closest to each other. As shown, the gap varies most in the condition 3, but varies least in the condition 1. Therefore, assuming that the developing zone has the same width as the width of the magnet brush, i.e., about 4 mm, the gap in the developing zone varies by only less than 0.1 mm in the condition 1, but varies by 0.1 mm or more in the conditions 2 and 3.

Figures 8, 9:
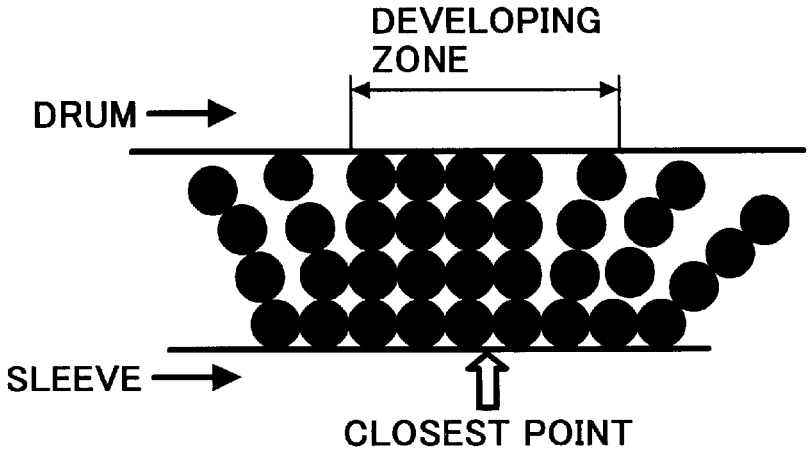
FIG. 8 is a table listing experimental results relating to the omission of trailing edges and that of portions around characters.
FIG. 9 is a sketch for describing why the omission of portions around characters occurs.

FIG. 8 lists the results of estimation effected in the conditions 1 through 3 as to the omission of trailing edges and that of portions around characters. Ranks 5 through 1 as to the omission of portions around characters are identical in meaning as to ranks 5 and 1 stated earlier; ranks 4 and 5 are fully acceptable in practical use. As shown, while rank 5 was achieved in all of the conditions 1 through 3 as to the omission of trailing edges, rank relating to the omission of portions around characters was 5 in the condition 1, but was sequentially lowered in the conditions 2 and 3.

How portions around a character are omitted will be described with reference to FIG. 9, which shows the density distribution of brush chains in the developing zone. In FIG. 9, the main pole 1 is positioned at the main pole angle of 0°, i.e., on the line connecting the center of the developing roller 4 and that of the drum 9. The actual gap for development is smallest at the point where the roller 4 and drum 9 are closest to each other, and increases at the sides upstream and downstream of the above point little by little at the same rate. Therefore, in FIG. 9, the brush chains become denser toward the point where the roller 4 and drum 9 are closest to each other. Therefore, a region where the developer is dense exists at a position upstream of the above particular point. By contrast, at a position downstream of the same point, the brush chains become rough because they move away from the narrow developing region. Consequently, when a boundary between a character portion and a halftone portion is brought to the developing zone, the electric lines of force concentrate on the character portion. When an excessive amount of toner is deposited on the character portion, the toner deposited on the halftone portion is returned to the brush chains due to counter charge left on the carrier. Such a phenomenon presumably accounts for the mechanism that causes portions around a character to be lost.

We studied developing conditions capable of obviating both of the omission of portions around characters and that of trailing edges in relation to the condition 3, which was worst as to the omission of the former. Various experiments showed that the omission of portions around characters was greatly dependent on the main pole angle for development, bias for development, and latent image forming conditions, as will be described hereinafter.

Figure 10:
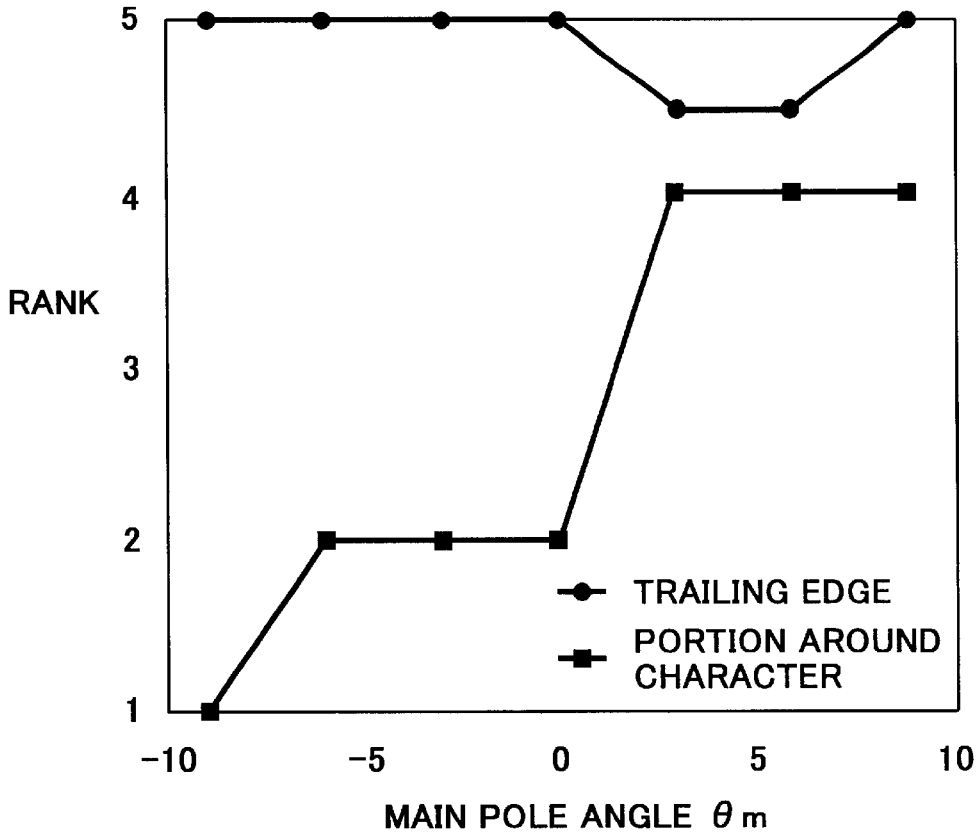
FIG. 10 is a graph showing a relation between the angel of a main pole, the omission of trailing edges and the omission of portions around characters achievable with the illustrative embodiment.

First, the angle of the main pole P1 will be described specifically. For experiments, the main pole P1 had an angle of 45° between opposite pole transition points, which lied in the range of 60° or below stated earlier. The main pole angle was varied by each 3° between −6° at the downstream side and 9° at the upstream side for estimating the omission. FIG. 10 shows the results of estimation.

As shown in FIG. 10, in the condition 3, rank as to the omission of trailing edges was 4.5 at angles of 3° and 6° at the downstream side, but was 5 at the other angles. Because rank 4.5 is fully acceptable in practical use, the omission of trailing edges is satisfactorily reduced at all of the main pole angles of −6° to 9°. As for the omission of portions around characters, rank was as low as 1 to 2 at angles of −9° to 0°, but was 4 at angles of 3° to 9°. It follows that rank as to this kind of omission is critically lowered when the angle of the main pole P1 is shifted to the downstream side, but is improved when it is shifted to the upstream side. In this respect, as for the condition 3, the angle of the main pole P1 should preferably be positioned at the upstream side. More preferably, the angle of the main pole P1 should be between 3° and 9° in order to obviate both of the two kinds of omissions described above.

Figure 11:
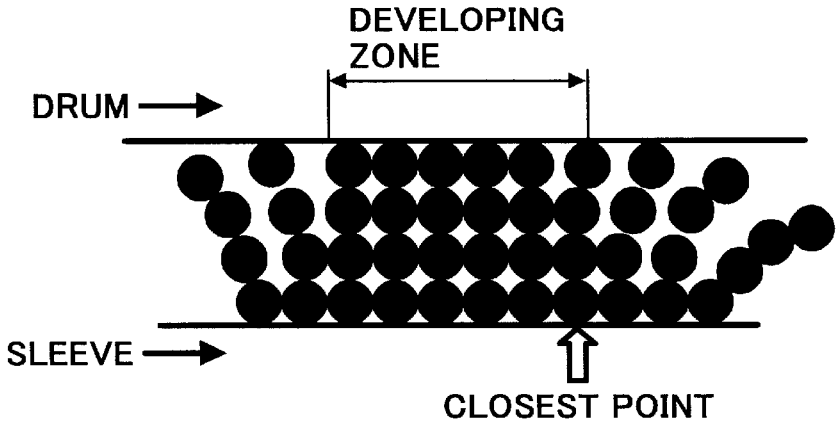
FIG. 11 is a sketch showing a mechanism that reduces the omission of portions around characters.

As shown in FIG. 11, when the main pole P1 is shifted to the upstream side, as stated above, the dense range of the developer at the side upstream of the point where the roller 4 and drum 9 are closest to each other is broadened. Consequently, the amount of toner deposition on a character portion saturates with the result that no counter charge is left on the magnet brush, reducing the omission of portions around characters.

Now, the allowance of the angle of the main pole P1 is ±2°. Considering this allowance in relation to the condition 3, when the angle of the main pole P1 is between 5° and 7°, the two kinds of omission stated above can be reduced at the same time even if the shift of the angle due to the allowance is maximum. In this manner, the illustrative embodiment improves even the margin as to the shift of allowance for thereby improving image quality.

Figure 12:
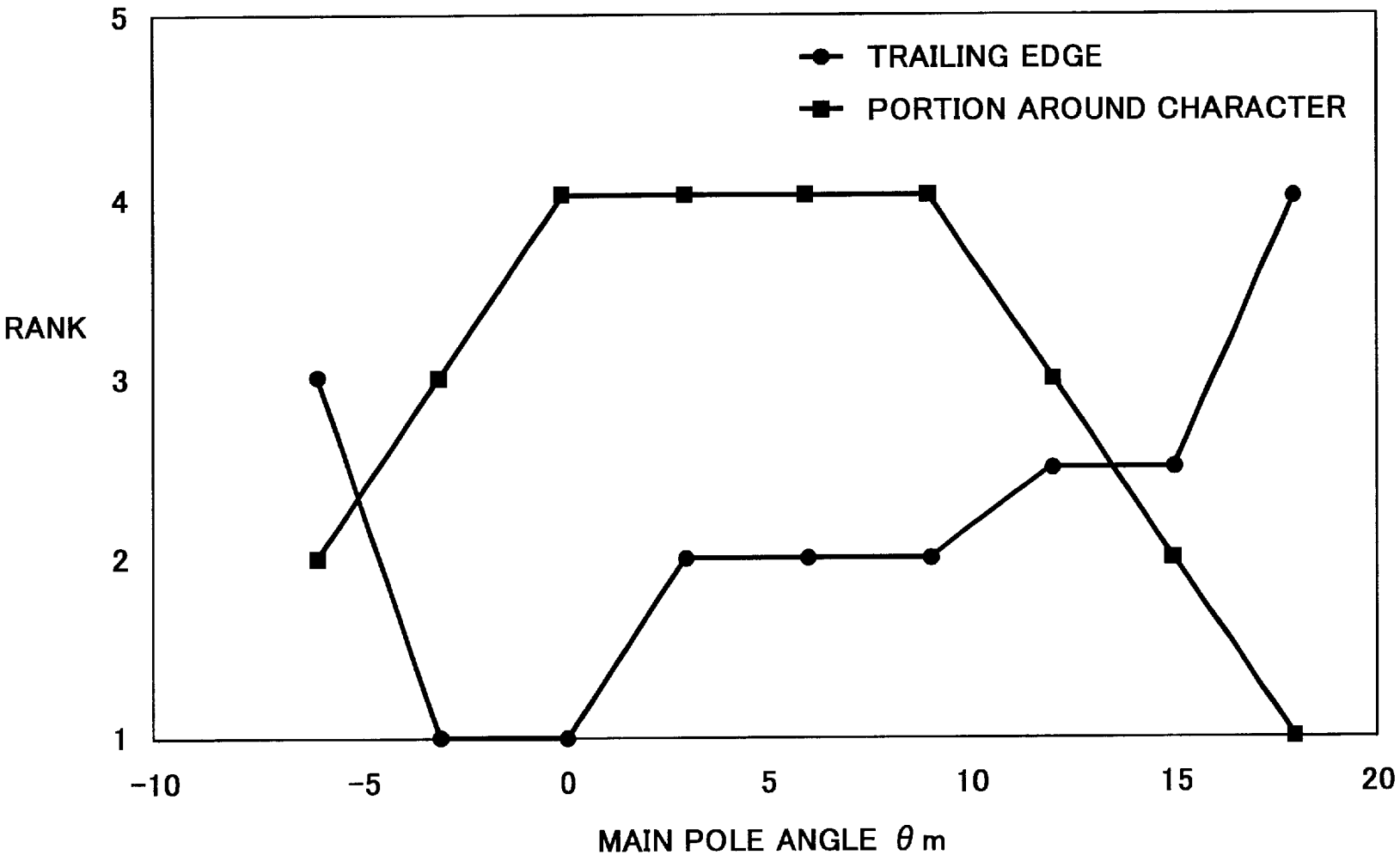
FIG. 12 is a graph showing a relation between the angle of a main pole, the omission of trailing edges and the omission of portions around characters particular to a conventional developing device.

FIG. 12 shows the results of experiments conducted to estimate the omission of portions around characters and that of trailing edges by increasing the angle between the pole transition points of the main pole P1 to 72°, which was greater than 60°. In this case, the angle of the main pole P1 was varied between −9° at the downstream side and 18° at the upstream side by each 3°. As FIG. 12 indicates, the range reducing the two kinds of omission at the same time is not available with the angle of 60° or above at all.

Figure 13:
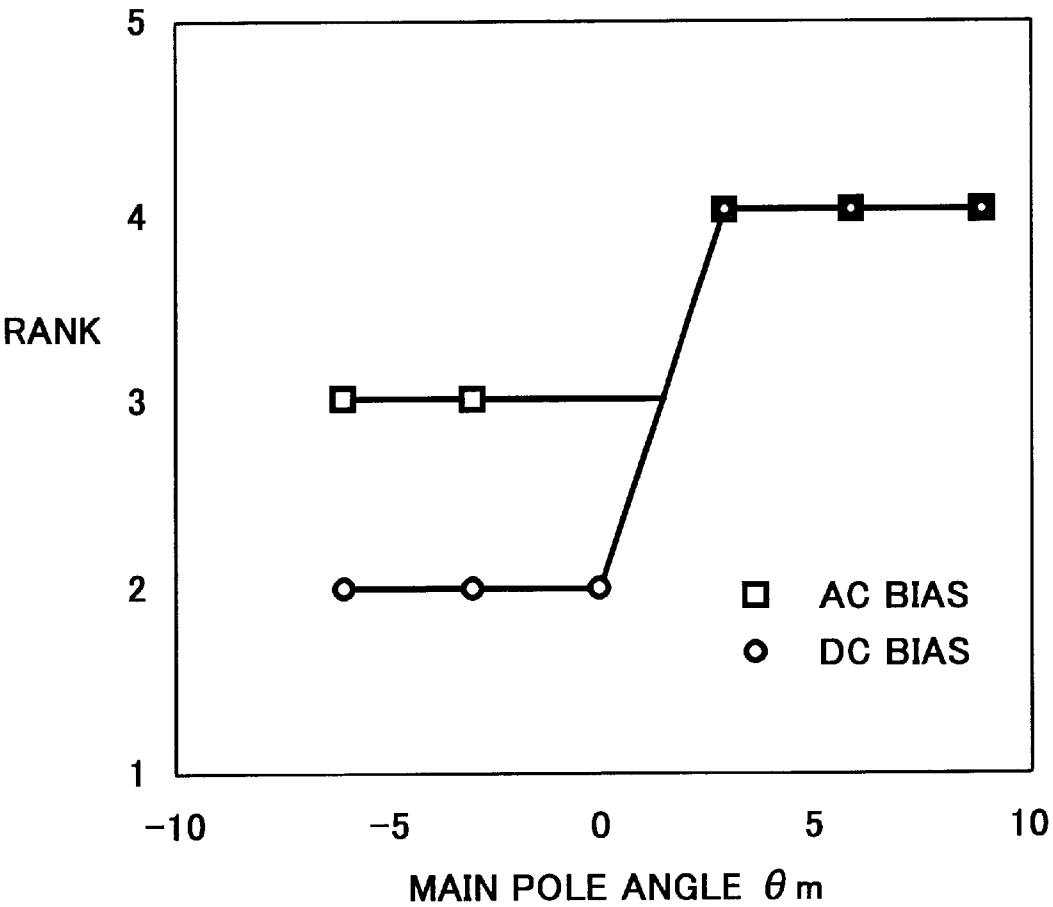
FIG. 13 is a graph showing a relation between a bias for development and the omission of trailing edges and that of portions around characters.

We studied the bias for development in relation to the condition 3. For experiments, the bias was implemented as an AC-biased DC voltage (AC bias hereinafter). While a sine wave, a triangular wave, a rectangular wave or blank pulses, for example, may be used as the AC bias, a rectangular wave was used for experiments. The rectangular wave had a duty ratio of 30%, a peak-to-peak voltage Vpp of 0.9 kV, and a frequency of 5 kHz. Of course, such AC conditions are only illustrative and will, in practice, be determined in accordance with the individual latent image condition and developing characteristic. The AC bias reduces the influence of the density of the magnet brush in the developing zone because the AC bias allows toner to fly not only from the tips of the brush chains but also from the roots of the same even in the portion where the magnet brush is rough. More specifically, as shown in FIG. 13 representative of experimental results, the AC bias generally improves rank as to the omission of portions around characters more than a DC bias.

Figures 14, 15:
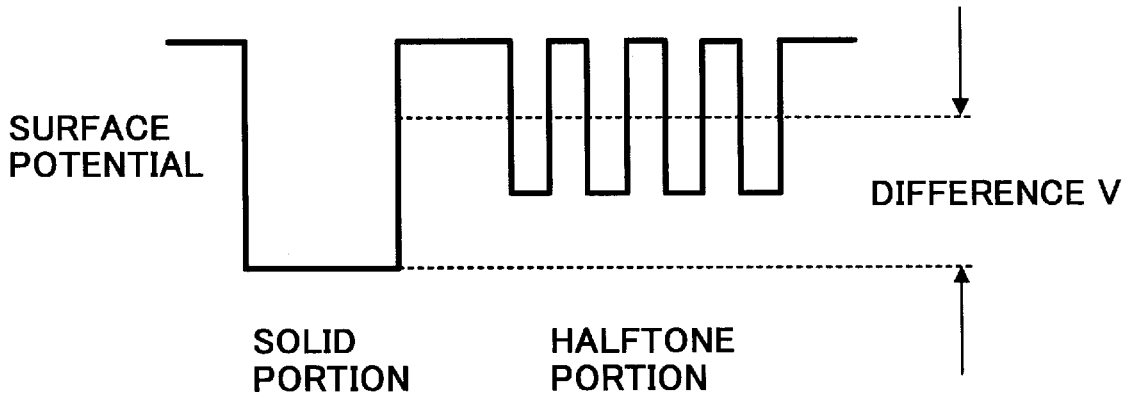
FIG. 14 shows a difference in surface potential between a solid portion and a halftone portion.
FIG. 15 is a table listing experimental results relating to a difference in mean potential between a solid portion and a halftone portion.

Further, we studied latent image forming conditions in relation to the condition 3. More specifically, we varied the mean potential of a latent image representative of a solid image (character) and the mean potential of a latent image representative of a halftone image by varying the pulse width and power of a beam. FIG. 14 shows a difference in potential between a solid portion and a halftone portion specifically. A difference V between the mean potential of the solid portion and that of the halftone portion was varied stepwise between 300 V and 100 V by each 50 V to see how image quality varies. FIG. 15 lists the results of experiments. As shown, rank as to the omission of portions around characters became higher with a decrease in the difference V in mean potential. This is because when a boundary between a solid portion and a halftone portion exists in the developing zone and when the above difference V is great, toner concentrates on the solid portion. By contrast, when the difference V is small, the concentration of the electric lines of force on the solid portion decreases, so that the above rank is improved.

In summary, it will be seen that the present invention provides a developing device and an image forming apparatus having various unprecedented advantages, as enumerated below.

(1) By selecting a particular angle between the zero-gauss points of a main pole and a particular minimum, normal flux density between the main pole and a conveying pole, it is possible to improve a margin as to a shift ascribable to an allowance for thereby stabilizing image quality.

(2) By causing a gap for development to vary in a particular manner in a developing zone (nip for development), it is possible to reduce the irregular density distribution of a developer at the nip for thereby stabilizing image quality. Also, in a system including a photoconductive element having a large radius of curvature, a point where the normal flux density of the main pole is maximum is coincident with a point where the photoconductive element and a sleeve are closest to each other. This further reduces the irregular density distribution of the developer at the nip for thereby stabilizing image quality despite a change in the amount of the developer or the allowance.

(3) In a system in which the radius of curvature of the photoconductive element is small, the point where the normal flux density of the main pole is maximum is positioned upstream of the point where the photoconductive element and sleeve are closest to each other in a direction of developer conveyance. This is also successful to reduce the irregular density distribution of the developer at the nip for thereby stabilizing image quality.

(4) The omission of trailing edges and that of portions around characters can be reduced at the same time.

(5) An AC alternating electric field is used for development to thereby reduce the influence of the density distribution of the developer at the nip.

(6) The concentration of toner on a solid image portion, which adjoins a halftone portion, is reduced, so that the above advantage (4) is also achieved.

Various modifications will become possible for those skilled in the art after receiving the teachings of the present disclosure without departing from the scope thereof.

What is claimed is:

1. In a developing device comprising a developer carrier facing an image carrier, which carries a latent image thereon, via a gap to thereby form a developing zone between said developer carrier and said image carrier, said developer carrier comprising a main magnetic pole for development and magnetic poles respectively positioned upstream and downstream of said main magnetic pole in a direction of developer conveyance for conveying a developer, said developer forming a magnet brush on a surface of said developer carrier, said main magnetic pole has an angle of 60° or below between opposite pole transition points respectively positioned upstream and downstream of said main pole in said direction of developer conveyance, and a flux density between said main magnetic pole and the magnetic pole downstream of said main magnetic pole in a normal direction has a peak value that is 80% of a maximum flux density of said main pole in said normal direction or above.

2. The developing device as claimed in claim 1, wherein when the gap between the image carrier and said developer carrier in the developing zone varies by less than 0.1 mm, said main magnetic pole is coincident with a position where the image carrier and said developer carrier are closest to each other.

3. The developing device as claimed in claim 2, wherein an AC bias, which is an AC-biased DC voltage, is used as a bias for development.

4. The developing device as claimed in claim 3, wherein a difference between a mean potential of a latent image representative of a solid portion and a mean potential of a latent image representative of a halftone portion is 200 V or below.

5. The developing device as claimed in claim 1, wherein when the gap between the image carrier and said developer carrier in the developing zone varies by less than 0.1 mm, said main magnetic pole is positioned upstream of a position where the image carrier and said developer carrier are closest to each other.

6. The developing device as claimed in claim 5, wherein said main magnetic pole is positioned at an angle of 3° to 9° upstream of the position where the image carrier and said developer carrier are closest to each other.

7. The developing device as claimed in claim 6, wherein an AC bias, which is an AC-biased DC voltage, is used as a bias for development.

8. The developing device as claimed in claim 7, wherein a difference between a mean potential of a latent image representative of a solid portion and a mean potential of a latent image representative of a halftone portion is 200 V or below.

9. The developing device as claimed in claim 1, wherein an AC bias, which is an AC-biased DC voltage, is used as a bias for development.

10. The developing device as claimed in claim 9, wherein a difference between a mean potential of a latent image representative of a solid portion and a mean potential of a latent image representative of a halftone portion is 200 V or below.

11. The developing device as claimed in claim 1, wherein a difference between a mean potential of a latent image representative of a solid portion and a mean potential of a latent image representative of a halftone portion is 200 V or below.

12. In an image forming apparatus comprising a developing device comprising a developer carrier facing an image carrier, which carries a latent image thereon, via a gap to thereby form a developing zone between said developer carrier and said image carrier, said developer carrier comprising a main magnetic pole for development and magnetic poles respectively positioned upstream and downstream of said main magnetic pole in a direction of developer conveyance for conveying a developer, said developer forming a magnet brush on a surface of said developer carrier, said main magnetic pole has an angle of 60° or below between opposite pole transition points respectively positioned upstream and downstream of said main pole in said direction of developer conveyance, and a flux density between said main magnetic pole and the magnetic pole downstream of said main magnetic pole in a normal direction has a peak value that is 80% of a maximum flux density of said main pole in said normal direction or above.

* * * * *